US007362044B2

(12) United States Patent
Hong et al.

(10) Patent No.: US 7,362,044 B2
(45) Date of Patent: Apr. 22, 2008

(54) ELECTRON GUN FOR CATHODE RAY TUBE AND CATHODE RAY TUBE WITH THE SAME

(75) Inventors: Young-Gon Hong, Suwon-si (KR); Nozomu Arimoto, Suwon-si (KR); Hoo-Deuk Kim, Suwon-si (KR); Min-Cheol Bae, Suwon-si (KR); Kue-Hong Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/372,049

(22) Filed: Mar. 10, 2006

(65) Prior Publication Data

US 2006/0202601 A1 Sep. 14, 2006

(30) Foreign Application Priority Data

Mar. 11, 2005 (KR) ..... 10-2005-0020517

(51) Int. Cl.
*H01J 29/50* (2006.01)
*H01J 29/46* (2006.01)
*H01J 29/58* (2006.01)

(52) U.S. Cl. ..... 313/414; 313/409; 313/441; 315/382; 315/382.1

(58) Field of Classification Search ..... 313/414, 313/442, 410, 409; 315/382, 382.1
See application file for complete search history.

(56) References Cited

U.S. PATENT DOCUMENTS

| | | | | |
|---|---|---|---|---|
| 6,166,484 | A * | 12/2000 | Okuyama et al. | 313/440 |
| 6,339,284 | B1 * | 1/2002 | Takekawa et al. | 313/414 |
| 6,608,435 | B1 * | 8/2003 | Kimiya et al. | 313/412 |
| 6,633,142 | B1 * | 10/2003 | Shirai et al. | 315/382 |
| 2001/0050526 | A1 * | 12/2001 | Miyamoto et al. | 313/417 |
| 2002/0017852 | A1 * | 2/2002 | Nakamura et al. | 313/414 |
| 2002/0113539 | A1 * | 8/2002 | Steinhauser et al. | 313/414 |
| 2004/0160387 | A1 * | 8/2004 | Kim et al. | 345/10 |
| 2005/0088074 | A1 * | 4/2005 | Yoon et al. | 313/414 |
| 2006/0202602 | A1 | 9/2006 | Hong et al. | |

* cited by examiner

*Primary Examiner*—Mariceli Santiago
(74) *Attorney, Agent, or Firm*—Robert E. Bushnell, Esq.

(57) ABSTRACT

A CRT includes an electron gun that includes a cathode adapted to emit thermal electrons, a first electrode and a second electrode adapted to form a triode portion together with the cathode, a plurality of focusing electrodes, an anode electrode and a subsidiary electrode arranged between the second electrode and a one of said plurality of focusing electrode adjacent to the second electrode. The subsidiary electrode is adapted to dynamically control an imaginary crossover point ofelectron beams emanating from the electron gun corresponding to landing locations ofthe electron beams on a phosphor screen of a panel in response to a voltage applied thereto.

6 Claims, 11 Drawing Sheets

ELECTRON GUN FOR CATHODE RAY TUBE AND CATHODE RAY TUBE WITH THE SAME

CLAIM OF PRIORITY

This application makes reference to, incorporates the same herein, and claims all benefits accruing under 35 U.S.C. §119 from an application for ELECTRON GUN FOR CATHODE RAY TUBE, earlier filed in the Korean Intellectual Property Office on Mar. 11, 2005 and there duly assigned Serial No. 10-2005-0020517.

BACKGROUND OF THE INVENTION

1. Field of the Invention

The present invention relates to an electron gun for a cathode ray tube display (CRT), and in particular, to an electron gun for a CRT which enhances the horizontal uniformity of electron beams over the entire screen area by additionally providing a subsidiary electrode and forming a pre-focus lens differentiated in intensity per the respective locations on the screen.

2. Description of Related Art

Generally, a CRT includes an electron gun for emitting electron beams, a deflection yoke for deflecting the electron beams, a shadow mask for color-selecting the electron beams, and a panel with an inner phosphor layer. The electron beams emitted from the electron gun are deflected by the magnetic field of the deflection yoke, and the deflected electron beams pass through the color-selecting shadow mask, and then collide with green, blue and red phosphors to emit light to display the desired images.

The electron gun of the CRT includes a cathode for emitting thermal electrons, a heater installed at the cathode to heat the cathode allowing for the emission of thermal electrons, and a plurality of electrodes for focusing and accelerating the thermal electrons emitted from the cathode. The electrodes include first and second electrodes that form a triode portion with the cathode, a plurality of focusing electrodes receiving focusing voltages, and an anode electrode receiving a high anode voltage.

As the screens of modem CRTs are larger and flatter than before, the center and the periphery of modem CRT screens have a larger variation in image clarity. Particularly, with the widening of the deflection angle (maximally up to 125°) to slim the CRT, the distance between the center and the periphery of the modem CRT screen becomes larger than that of earlier CRT screens having a deflection angle of 102-106°. This can result in poor horizontal uniformity of the electron beams. The horizontal uniformity is deteriorated due to the excessive deflection aberration of the deflection yoke.

In an electron gun, electrons are emitted from a cathode pass a first electrode portion while forming into electron beams. The electron beams are primarily pre-focused at a pre-focus lens portion, followed by passing a dynamic auto-focus lens portion while being pre-diffused. Then, the electron beams pass a main lens portion while being focused, and collide against the phosphor screen of the panel. As the trajectory of the electron beams directed toward the center is different in distance from that of the electron beams directed toward the periphery, the focusing forms (i.e., whether the electron beam is under-focused, over-focused or focusedjust right) ofthe electron beams landing on the screen are different from each other. The electron beams beyond the main lens portion are deflected, and the electron beams are increasingly over-focused at portions on the screen furthest from the center of the screen along the horizontal direction (in the direction of the X axis).

The over-focusing of the electron beams occurs because the electric field lens produced by the deflection yoke of the wide-angled CRT (the influence of the horizontal pin cushion electric field) is strengthened. Such electron beams are focused in the shape of a longitudinal oval with a long horizontal diameter and a short vertical diameter. The electron beams along the horizontal direction of the panel (in the direction of the X axis) are under-focused at the center of the screen, properly focused (i.e., focused just right) at the ½ location ofthe screen, and an over focused at the left and right ends of the screen. As proper focusing occurs at the ½ location (between the center and ends on the X axis) of the screen, the beam diameter is too small compared to the pitch of the shadow mask, and a ring-shaped moire induced by the interference is generated, thus deteriorating the display image quality. Therefore, what is needed is an improved design for an electron gun for a CRT that is better suited for today's large screen flat panel designs that overcomes this moire at the ½ location and reduces over-focusing at the edges of the CRT along the horizontal axis of the CRT.

SUMMARY OF THE INVENTION

It is therefore an object of the present invention to provide an improved design for an electron gun for a CRT.

It is also an object of the present invention to provide a design for an electron gun that is more suitable for today's large screen flat panel CRTs.

It is further an object of the present invention to provide an electron gun for a CRT which improves the horizontal electron beam focusing uniformity by providing a subsidiary electrode and forming a dynamically variable lens at a pre-focus lens portion, thereby enhancing the display image quality.

It is another object ofthe present invention to provide a CRT which improves the horizontal electron beam focusing uniformity by providing a subsidiary electrode and forming a dynamically variable lens at a pre-focus lens portion, thereby enhancing the display image quality.

According to one aspect of the present invention, an electron gun for a CRT that includes a cathode adapted to emit thermal electrons, a first electrode and a second electrode adapted to form a triode portion together with the cathode, a plurality of focusing electrodes, an anode electrode and a subsidiary electrode arranged between the second electrode and a one of said plurality of focusing electrode adjacent to the second electrode, the subsidiary electrode being adapted to dynamically control an imaginary crossover point of electron beams emanating from the electron gun corresponding to landing locations of the electron beams on a phosphor screen of a panel in response to a voltage applied thereto.

The subsidiary electrode can be adapted to receive a dynamic voltage synchronized with a horizontal deflection scanning. The dynamic voltage applied to the subsidiary electrode can be varied in the shape of a waveform of a parabola symmetrical to each other left and right with respect to the middle point of the horizontal deflection scanning time. The subsidiary electrode can include a plurality of apertures perforating the subsidiary electrode, the plurality of apertures can be adapted so that a vertical opening diameter of each apertures is smaller than a horizontal opening diameter of each aperture. The shape of each of the plurality of apertures perforating the subsidiary electrode can be either a rectangular, an oval or a track shape.

According to another aspect of the present invention, there is provided aCRT that includes a panel, a funnel and a neck connected to each other to form a vacuum vessel, a phosphor layer arranged on an inner surface of the panel, the phosphor layer comprising red, blue and green phosphors having a predetermined pattern, an electron gun arranged within the neck, the electron gun being adapted to emit and focus electron beams, a deflection yoke arranged around an outer circumference of the funnel and adapted to deflect the electron beams emitted from the electron gun and a shadow mask arranged within the panel and adapted to color-selectively pass the electron beams emitted from the electron gun so that the electron beams land on the relevant phosphors of the phosphor layer.

The electron gun can include a cathode adapted to emit thermal electrons, a first electrode and a second electrode adapted to form a triode portion together with the cathode, a plurality of focusing electrodes, an anode electrode and a subsidiary electrode arranged between the second electrode and a one of said plurality of focusing electrode adjacent to the second electrode.

The subsidiary electrode can be adapted to receive a dynamic voltage synchronized with a horizontal deflection scanning to dynamically control an imaginary crossover point of electron beams corresponding to landing locations of the electron beams passed a main lens on a phosphor screen of a panel.

The dynamic voltage applied to the subsidiary electrode can be varied in the shape of a waveform of a parabola symmetrical to each other left and right with respect to the middle point of the horizontal deflection scanning time. The subsidiary electrode can include a plurality of apertures perforating the subsidiary electrode, the plurality of apertures being adapted so that a vertical opening diameter of each apertures is smaller than a horizontal opening diameter of each aperture. A maximum deflection angle of the electron beams deflected by the deflection yoke can be 110° or more.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
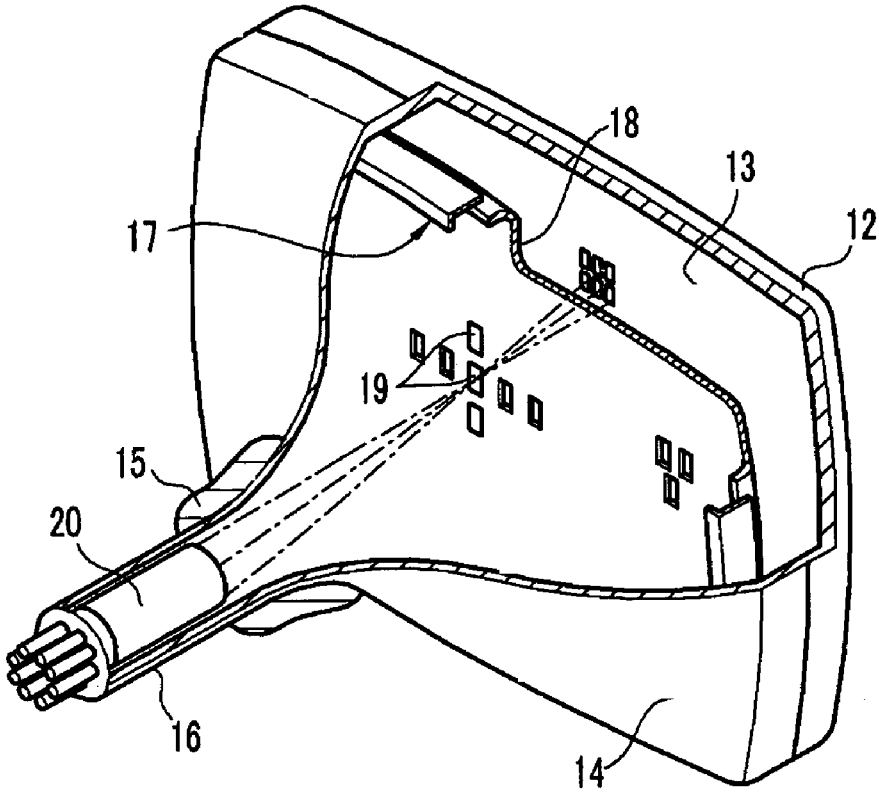
FIG. 1 is a partial sectional perspective view of a CRT according to an embodiment ofthe present invention.

Turning now to FIG. 1, FIG. 1 illustrates a CRT according to an embodiment of the present invention. The CRT of FIG. 1 includes a panel 12, a funnel 14 and a neck 16 serially connected to each other to form a vacuum vessel. A phosphor layer 13 is formed on the inner surface of the panel and has a pattern of red, blue and green phosphors. The phosphor layer 13 is formed by stripe-patterning red R, green G and blue B phosphors on the inner surface of the panel 12 with an black matrix layer BM in between. An electron gun 20 is installed in the neck 16 and serves to emit and focus electron beams. A deflection yoke 15 is mounted around the outer circumference of the funnel 14 and serves to deflect the electron beams emitted from the electron gun 20. A shadow mask 18 is installed within the panel 12 to color-selectively pass the electron beams emitted from the electron gun 20 so that the electron beams land on the phosphors of the phosphor layer 13. The shadow mask 18 is fitted to the panel 12 via a frame 17 so that it is spaced apart from the phosphor layer 13 by a distance. A plurality of beam passage holes 19 are formed in the shadow mask 18 to form a pattern.

In order to make the device thin, the deflection angle of the deflection yoke 15 is widened so that the maximum value thereof reaches 110° or more (compared to a CRT with a maximum deflection angle of 102-106°). Other structural components ofthe CRT are the same as those related to the common CRTs, and detailed explanation thereof will be omitted.

With the above structured CRT, the electron beams emitted from the electron gun 20 are deflected by the deflection magnetic field of the deflection yoke 15. The electron beams pass through the beam passage holes 19 in the shadow mask 18 and collide with the green, blue and red phosphors of the phosphor layer 13, thus producing visible light that displays the desired screen images.

Figure 2:
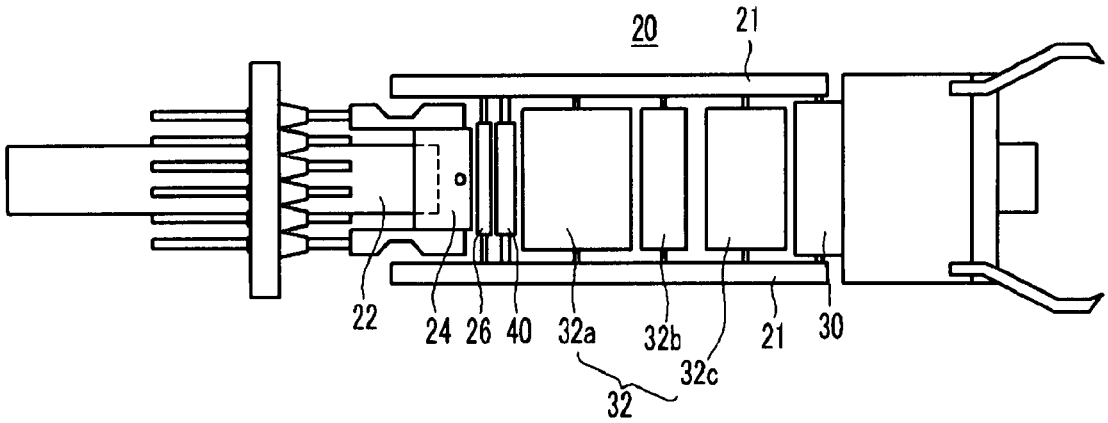
FIG. 2 is a side view of an electron gun in the CRT of FIG. 1 according to an embodiment of the present invention.
Figure 3:
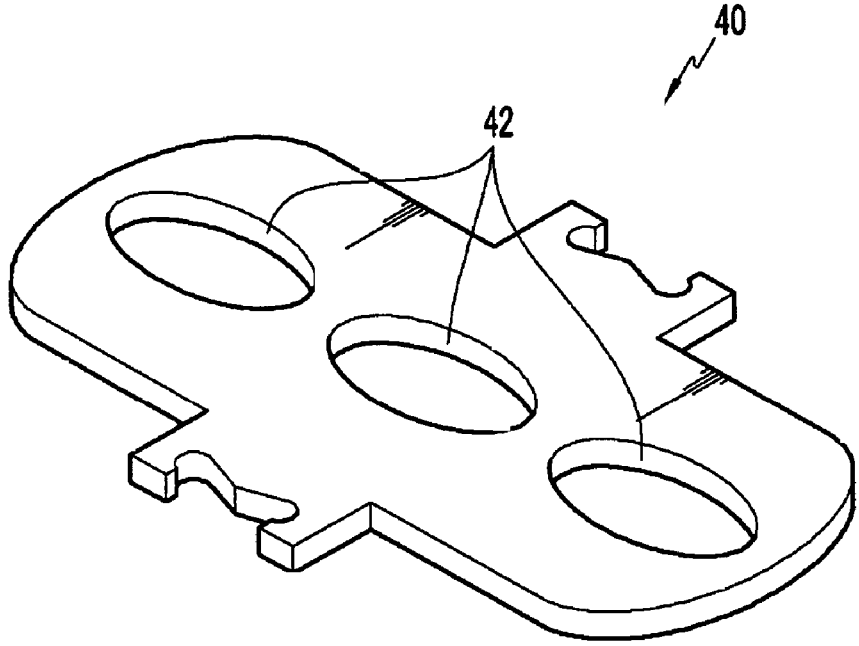
FIG. 3 is a perspective view of a subsidiary electrode in the electron gun in the CRT of FIG. 1 according to an embodiment of the present invention.

Turning now to FIGS. 2 and 3, FIG. 2 illustrates the electron gun 20 for a CRT according to an embodiment of the present invention. The electron gun 20 includes a cathode 22 for emitting thermal electrons, first and second electrodes 24 and 26 that form a triode portion together with the cathode 22, a focusing electrode 32, an anode electrode 30, and a subsidiary electrode 40. In the embodiment, the focusing electrode 32 includes a plurality of focusing electrodes 32*a*, 32*b*, and 32*c*, and the subsidiary electrode 40 is disposed between the second electrode 26 and the focusing electrode 32, which is close to the second electrode 26.

The first and second electrodes 24 and 26, the focusing electrode 32, the anode electrode 30, and the subsidiary electrode 40 are fixed to a bead glass 21. Apertures 42 are formed in the subsidiary electrode 40 so that the vertical diameters thereof are smaller than the horizontal diameters thereof. The apertures 42 are arranged respectively corresponding to the red, blue, and green electron beams. Each aperture 42 has either a longitudinal oval, a track, or a rectangular shape so that the horizontal length thereof is longer than the vertical length. A dynamic voltage VGS synchronized to the horizontal deflection scanning is applied to the subsidiary electrode 40.

Figure 4:
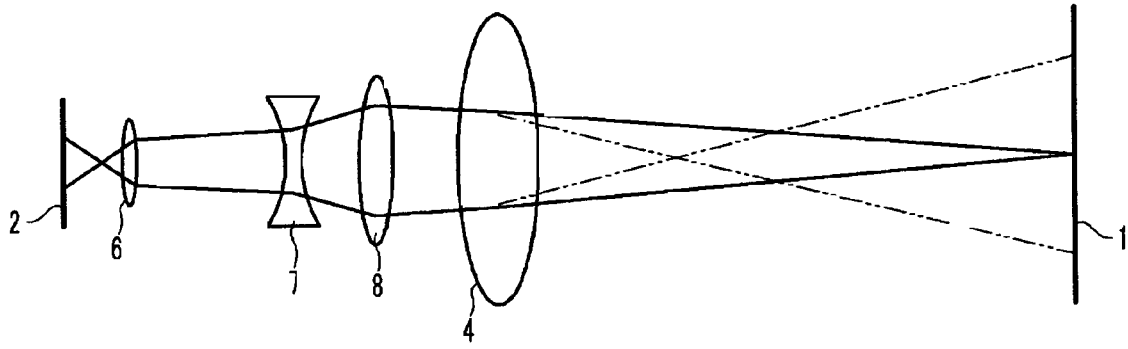
FIG. 4 schematically illustrates the operation of lenses and the trajectory of electron beams with an electron gun for a CRT.

Turning now to FIG. 4, FIG. 4 illustrates a lens formed by respective electrodes and the trajectory of electron beams in an electron gun in a CRT. The electrons emitted from the cathode 2 pass a first electrode portion while forming electron beams. The electron beams are primarily pre-focused at a pre-focus lens portion 6, followed by passing a dynamic auto-focus lens portion 7 while being pre-diffused. Then, the electron beams pass a main lens portion 8 while being focused, and collide against a phosphor screen 1 of a panel of the CRT. The trajectory of the electron beams indicated by a solid line in FIG. 4 represents the focusing form of the electron beams deflected toward the center of the phosphor screen 1, and the trajectory of the electron beams indicated by a dots-dash line represents the focusing form of the electron beams deflected toward the periphery (both-sided ends) ofthe phosphor screen 1. In FIG.4, the reference number 4 indicates a lens formed by a deflection magnetic field of a deflection yoke 15 of the CRT.

Figure 5:
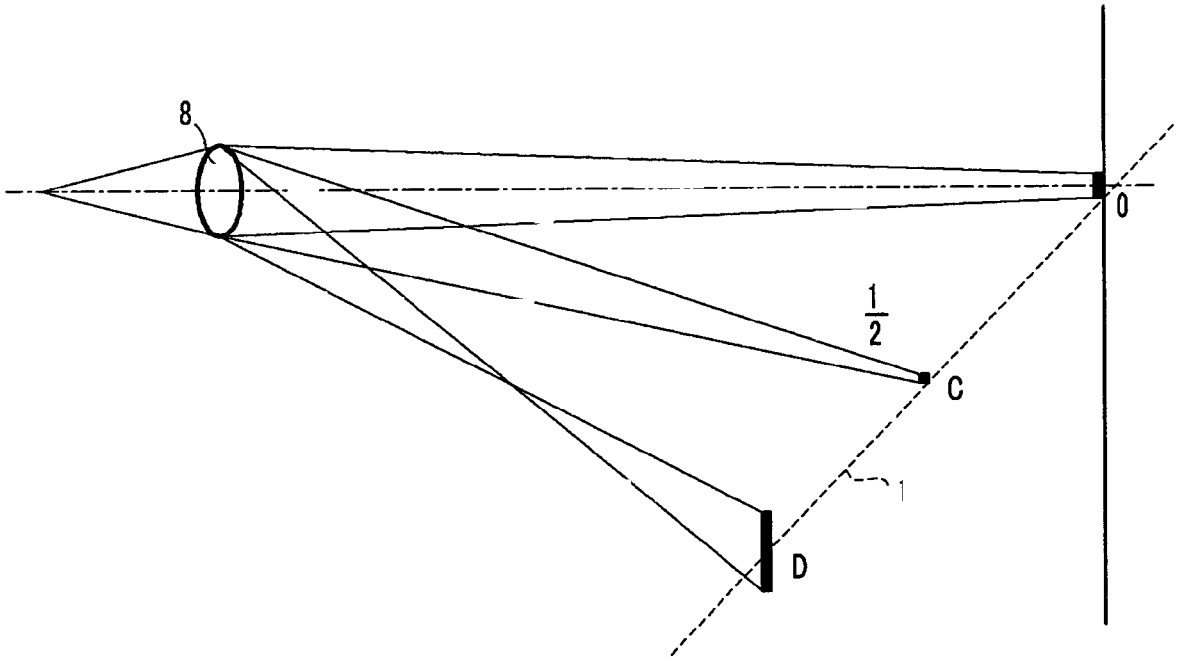
FIG. 5 schematically illustrates the horizontal trajectory of electron beams with an electron gun for a CRT.

As the trajectory of the electron beams directed toward the center is different in distance from the trajectory of the electron beams directed toward the periphery, the focusing forms (i.e., over-focused, under-focused or properly focused) of the electron beams landing on the screen 1 are different from each other. As shown in FIG. 5, the electron beams beyond the main lens portion 8 are deflected, and the electron beams are increasingly over-focused at portions on the screen furthest from the center 0 of the screen 1 in the horizontal direction (in the direction of the X axis).

Figure 6:
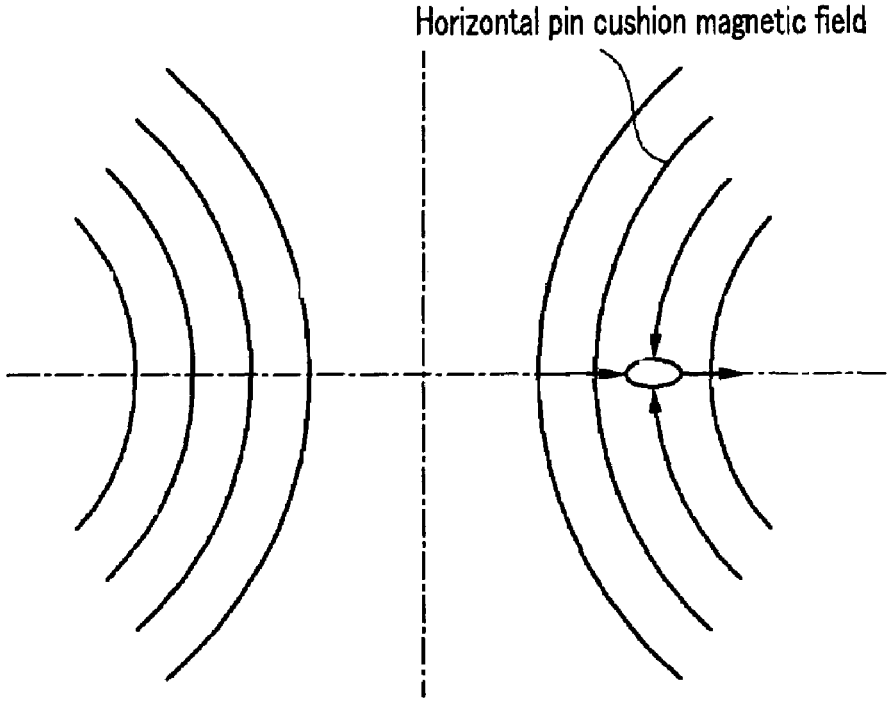
FIG. 6 schematically illustrates the deformation ofelectron beams due to the magnetic field of a deflection yoke.
Figure 7:
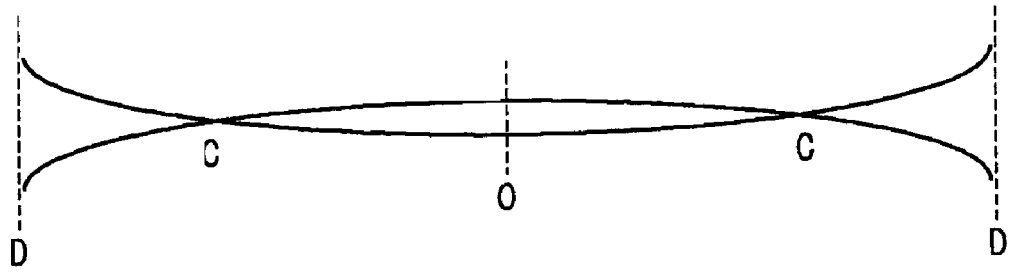
FIG. 7 schematically illustrates the horizontal focusing form of electron beams on the screen.

As shown in FIG. 6, the over-focusing of the electron beams occur because the magnetic field lens due to the deflection yoke of the wide-angled CRT (the influence of the horizontal pin cushion electric field) is strengthened. Such electron beams are focused in the form of a longitudinal oval with a long horizontal diameter and a short vertical diameter. That is, as shown in FIGS. 5 and 7, the electron beams along the horizontal direction of the panel (in the direction of the X axis) are under-focused at the center 0 of the phosphor screen 1, properly focused at the ½ location (C) of the phosphor screen 1, and an over focused at the left and right ends D of the phosphor screen 1. As proper focusing occurs at the ½ location C of the phosphor screen 1, the beam diameter here is too small compared to the pitch of the shadow mask, and a ring-shaped moire induced by the interference generated, thus deteriorating the display image quality.

Figure 8:
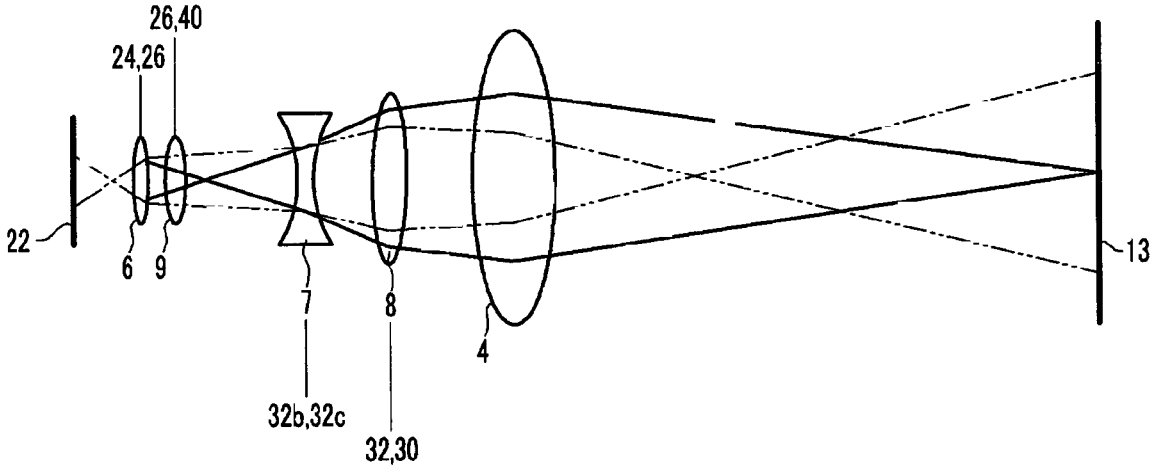
FIG. 8 schematically illustrates the operation of lenses and the trajectory of electron beams with an electron gun for a CRT according to an embodiment of the present invention.

Turning now to FIG. 8, FIG. 8 illustrates the operation of lenses and the trajectory of electron beams having the electron gun 20 for the CRT according to an embodiment of the present invention. As illustrated in FIG. 8, the electrons emitted from the cathode 22 are primarily pre-focused at a pre-focus lens portion 6. Unlike the arrangement in FIG. 4, the electron beam of FIG. 8 passes through dynamic pre focus lens portion 9 which is made up of the novel subsidiary electrode 40. Following this, the electron beam passes a dynamic auto-focus lens portion 7 while being pre-diffused. Then, the electron beams pass a main lens portion 8 while being focused, and then collides against the phosphor layer 13 on the panel 12. The reference number 4 indicates a lens formed by the deflection magnetic field of the deflection yoke 15.

As shown in FIGS. 7 and 8, with the above-structured electron gun 20, the pre-focus lens portion 6 is formed by the first and the second electrodes 24 and 26, the dynamic pre-focus lens portion 9 is formed by the second electrode 26 and the subsidiary electrode 40, the dynamic auto-focus lens portion 7 by the focusing electrodes 32*b* and 32*c*, and the main lens portion 8 by the focusing electrode 32 and the anode electrode 30.

In the electron gun 20 for a CRT according to the present invention, the subsidiary electrode 40 receives the dynamic voltage $V_{GS}$ that is synchronized to the horizontal deflection scanning so that when the electron beams land on the phosphor layer 13 of the panel 12 via the main lens portion 8, the imaginary crossover point of the electron beams can be dynamically controlled corresponding to the landing locations of the electron beams.

Figure 9:
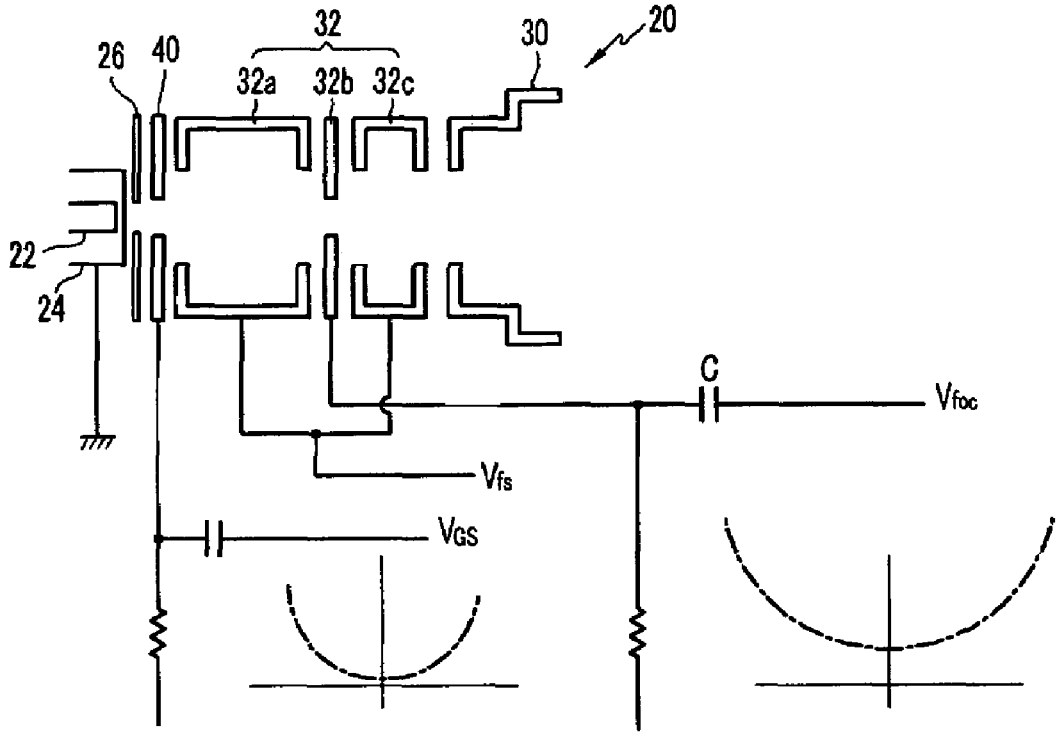
FIG. 9 is a schematic side elevation view of an electron gun for a CRT according to an embodiment of the present invention, illustrating the way of applying voltages to a subsidiary electrode.
Figure 10:
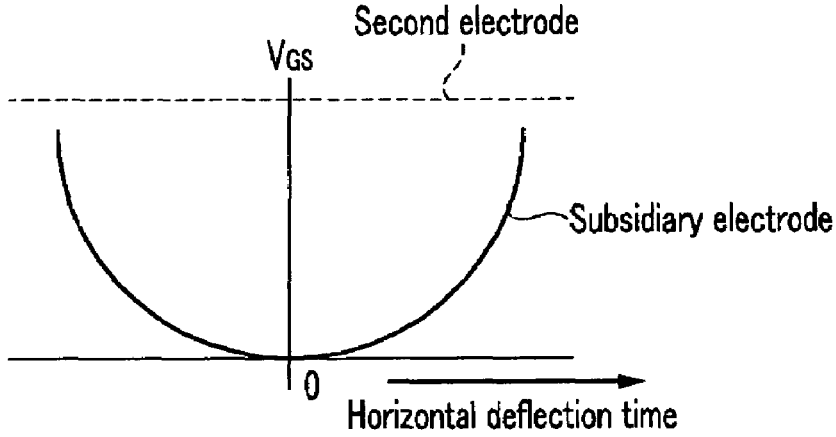
FIG. 10 is a graph illustrating the waveform of the dynamic voltage applied to the subsidiary electrode according to an embodiment of the present invention.

In order to operate the dynamic pre-focus lens portion 9, as shown in FIGS. 9 and 10, the dynamic voltage $V_{GS}$ applied to the subsidiary electrode 40 is varied in the shape of a waveform of a parabola symmetrical to each other left and right with respect to the middle time point of the horizontal deflection scanning time.

Figure 11:
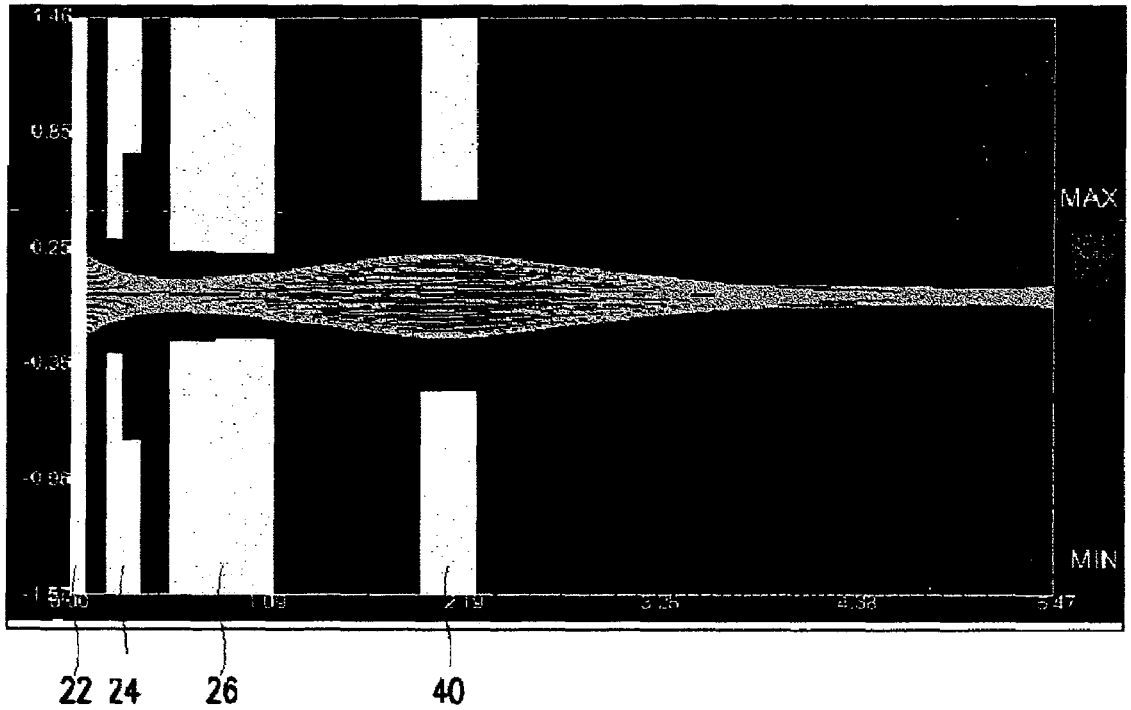
FIG. 11 is a photograph of a simulation image of the trajectory of electron beams with an electron gun for a CRT according to an embodiment of the present invention.

When the dynamic voltage $V_{GS}$ is applied to the subsidiary electrode 40 as shown in FIGS. 8 and 11, the electron beams exhibit a double crossover trajectory where the electron beams crossover at the rear end of the first electrode 24 and the rear end of the subsidiary electrode 40, respectively. As shown in FIG. 8, the solid line indicates the trajectory of the electron beams when the dynamic voltage $V_{GS}$ is applied to the subsidiary electrode 40, and the dots-dash line indicates the electron beam trajectory when no voltage is applied to the subsidiary electrode 40. That is, as shown in FIG. 8, when the dynamic voltage $V_{GS}$ is applied to the subsidiary electrode 40, a double crossover trajectory where the electron beams re-crossover occurs because of the addition of the dynamic pre-focus lens portion 9, so that a proper focus is achieved, even at the periphery D of the phosphor layer 13. In case where no voltage is applied to the subsidiary electrode 40, an over focus of the electron beams occurs at the periphery D of the phosphor layer 13, as indicated by the dots-dash line in FIG. 8.

Since the dynamic voltage $V_{GS}$ is applied to the subsidiary electrode 40 only with the horizontal deflection scanning, it is operated with the horizontal deflection scanning to re-focus the electron beams focused through the pre-focus lens portion 6. When the dynamic voltage $V_{GS}$ applied to the subsidiary electrode 40 increases, the effect of the decelerating lens becomes weak so that the double cross point is shifted toward the main lens portion 8, and the vertical beam focusing point is shifted toward the phosphor layer 13. In this way, as it is possible for the vertical beam focusing point to be dynamically shifted toward the phosphor layer 13, it becomes possible to prevent the over focusing, thus enhancing the horizontal uniformity.

The electron beams crossed-over through the first electrode 24 are pre-focused at the pre-focus lens portion 6, and further focused at the dynamic pre-focus lens portion 9 by the subsidiary electrode 40, followed by being incident to the dynamic auto-focus lens portion 7 at a large angle. As a result, the electron beams are largely diffused at the front end of the dynamic auto-focus lens portion 7, and focused two times so that they be properly focused on the phosphor layer 13.

The apertures 42 in the subsidiary electrode 40 can have a rectangular, an oval or a track shape where the vertical opening diameter is smaller than the horizontal opening diameter. Therefore, the electron beams are scanned toward the periphery of the panel 12 with a shape where the vertical diameter is larger than the horizontal diameter. Consequently, when the electron beams land on the phosphor layer 13 through the shadow mask 18, the deformation thereof where the vertical diameter is reduced while the horizontal diameter is elongated due to the influence of the vertical pin cushion electric field can be compensated for.

In order to make the CRT thin, it is more effective to apply the electron gun 20 to a CRT where the maximum deflection angle is 110° or more (compared to a CRT where the maximum deflection angle is in the range of 102-106°).

With the electron gun for a CRT according to the present invention, a subsidiary electrode is provided to apply a dynamic voltage in synchronization with the horizontal deflection scanning so that it becomes possible to shift the focusing point of the electron beams, and to form a proper focus at the periphery of the screen. Consequently, it is possible to enhance the horizontal uniformity on the screen, and to heighten the display image quality by preventing the occurrence of moire due to the interference.

In the above embodiment, the electron gun is limited to that the electron gun is driven by a dynamic type. However, the present invention is not limited thereto and may include a static driving type for an electron gun.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron gun, comprising:

a cathode adapted to emit thermal electrons;

a first electrode and a second electrode functioning as a triode portion together with the cathode;

a plurality of focusing electrodes including a first focusing electrode adapted to receive a static focus voltage, a second focusing electrode adapted to receive a dynamic focus voltage, and a third focusing electrode adapted to receive the static focus voltage, the first and third focusing electrodes being tube-shaped and the second focusing electrode being plate-shaped;

an anode electrode; and a subsidiary electrode arranged between the second electrode and the first focusing electrode, the subsidiary electrode being adapted to receive a dynamic voltage synchronized with a horizontal deflection scan time, wherein the dynamic voltage applied to the subsidiary electrode has a shape of a waveform of a parabola symmetrical on left and right sides with respect to a middle point of the horizontal deflection scanning time.

2. The electron gun of claim 1, the subsidiary electrode being perforated by a plurality of apertures, the shape of each of said apertures being adapted to compensate for an improper focus of the electron beam.

3. An electron gun comprising:

a cathode adapted to emit thermal electrons;

a first electrode and a second electrode functioning as a triode portion together with the cathode;

a plurality of focusing electrodes including a first focusing electrode adapted to receive a static focus voltage, a second focusing electrode adapted to receive a dynamic focus voltage, and a third focusing electrode adapted to receive the static focus voltage, the first and third focusing electrodes being tube-shaped and the second focusing electrode being plate-shaped;

an anode electrode; and a subsidiary electrode arranged between the second electrode and the first focusing electrode, the subsidiary electrode being adapted to receive a dynamic voltage synchronized with a horizontal deflection scan time, wherein the subsidiary electrode comprises a plurality of apertures perforating the subsidiary electrode, the plurality of apertures each having a vertical opening diameter smaller than a horizontal opening diameter.

4. The electron gun of claim 3, wherein a shape of each of the plurality of apertures perforating the subsidiary electrode has a shape selected from a group consisting of a rectangle, an oval and a track.

5. A cathode ray tube display (CRT), comprising:

a panel, a funnel and a neck connected to each other to form a vacuum vessel;

a phosphor layer arranged on an inner surface of the panel, the phosphor layer including red, blue and green phosphors having a pattern;

an electron gun arranged within the neck, the electron gun being adapted to emit and focus electron beams;

a deflection yoke arranged around an outer circumference of the funnel and adapted to deflect the electron beams emitted from the electron gun with a maximum deflection angle greater than 110°; and a shadow mask arranged within the panel and adapted to color-selectively pass the electron beams emitted from the electron gun to land on the relevant phosphors of the phosphor layer, wherein the electron gun includes a cathode adapted to emit thermal electrons, a first electrode and a second electrode functioning as a triode portion together with the cathode, a plurality of focusing electrodes including a first focusing electrode adapted to receive a static focus voltage, a second focusing electrode adapted to receive a dynamic focus voltage, and a third focusing electrode adapted to receive the static focusing voltage, an anode electrode, and a subsidiary electrode arranged between the second electrode and the first focusing electrode adjacent to the second electrode, the first and third focusing electrodes being tube-shaped and the second focusing electrode being plate-shaped, and wherein the subsidiary electrode is adapted to receive a dynamic voltage synchronized to a horizontal deflection scanning time, wherein the subsidiary electrode comprises a plurality of apertures perforating the subsidiary electrode, the plurality of apertures each having a vertical opening diameter smaller than a horizontal opening diameter.

6. The CRT of claim 5, wherein the dynamic voltage applied to the subsidiary electrode has a waveform of a parabola symmetrical to each other left and right with respect to the middle point of a horizontal deflection scanning time.

* * * * *